United States Patent [19]

Vrignaud

[11] Patent Number: 4,656,902

[45] Date of Patent: Apr. 14, 1987

[54] METAL STAMPING TOOL WITH WORKING PARTS REMOVABLE WHILE ON THE MACHINE

[75] Inventor: Dorice Vrignaud, La Roche sur Yon, France

[73] Assignee: Esswein S.A., La Roche sur Yon, France

[21] Appl. No.: 794,673

[22] Filed: Nov. 4, 1985

[30] Foreign Application Priority Data

Nov. 11, 1984 [FR] France ..... 84 17112

[51] Int. Cl.[4] ..... B26F 1/14

[52] U.S. Cl. ..... 83/136; 83/375; 83/454; 83/698; 83/130

[58] Field of Search ..... 83/698, 136–143, 83/385, 375, 454, 453, 130; 72/326

[56] References Cited

U.S. PATENT DOCUMENTS 3,125,917 3/1964 Smeets ..... 83/140
3,140,630 7/1964 Wolf ..... 83/140
3,673,902 7/1972 Strobel ..... 83/133
4,103,574 8/1978 Greer ..... 83/140

FOREIGN PATENT DOCUMENTS 2413207 7/1979 France .

*Primary Examiner*—James M. Meister
*Attorney, Agent, or Firm*—Cushman, Darby & Cushman

[57] ABSTRACT

A stamping machine tool having working parts in the form of one or several matrices and one or several stamps, and a blank-holder guiding the stamp(s) in its(-their) displacements and securing in position against this or these matrices during the working stroke, a sheet metal piece subjected to a form shaping operation and wherein there is provided between the matrices and the stamp(s) a blank-holder that performs at least one normal working stroke and two withdrawal strokes, at will, namely a normal withdrawal stroke and an intervention withdrawal stroke which allow a dismantling of the working parts of the tool while on the machine.

7 Claims, 6 Drawing Figures

FIG_1-c
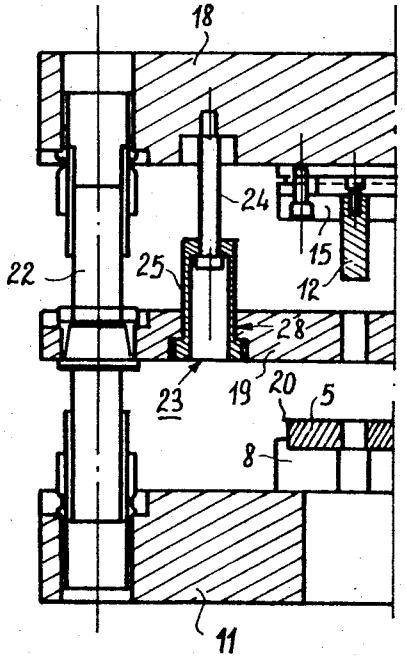
FIG_1-b
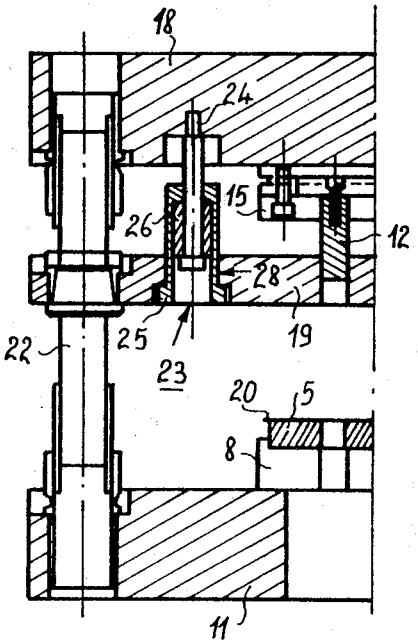
FIG_1-a
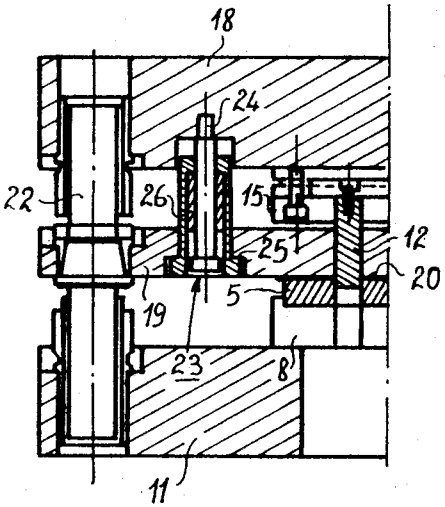

METAL STAMPING TOOL WITH WORKING PARTS REMOVABLE WHILE ON THE MACHINE

BACKGROUND OF THE INVENTION

1. Field of the invention

The present invention concerns a metal stamping tool with working parts that can be removed while on the machine, especially intended for carrying out operations upon sheet metal pieces.

2. Description of the prior art

For manufacturing pieces in sheet metal, tools are normally used that are fitted upon stamping machines in order to carry out punching, stamping, cambering, etc. operations. These tools usually each comprise working parts such as stamps and matrixes that are subjected to more or less rapid wear, holding pieces such as stamp-holders, matrix-holders, attachment blocks that are respectively mounted upon the slide and the table of the stamping machine, and a blank-holder usually intended both to secure firmly in position a sheet metal piece undergoing a shaping and in guiding these stamps within their sliding. Due to the fact that these stamps are more or less brittle, stamping tools are currently conceived in such a way that during rest or at the end of their withdrawal or disengagement stroke, the ends of their stamps still remain partially engaged within the guiding holes formed within their blank-holder. This means that during operations for their replacement, change or service maintenance, these stamps cannot be removed while the tools are still on the machine, i.e. in position upon the stamping machines. Accordingly, a replacement, service maintenance or change of stamps and matrixes in these known tools cannot be carried out while on the machine, it presents a loss of working time and relatively high man-power costs.

SUMMARY OF THE INVENTION

The aim of the present invention is to overcome these drawbacks by allowing to produce a relatively inexpensive stamping tool with working parts, especially stamps, removable while on the machine, intended to be fitted upon a stamping machine in order to carry out form shaping operations of a sheet metal piece such as stamping, punching, cambering, cutting, etc.

A stamping tool having working parts in the form of one or several matrixes and one or several stamps and a blank-holder guiding this or these stamp(s) during its(-their) stroke and securing in position against this or these matrixe(s) during its working stroke, a sheet metal piece subjected to a form shaping operation, is provided according to the invention, between the matrix(es) and the stamp(s) with a blank-holder that performs at least one normal working stroke and two withdrawal strokes at will, namely a normal withdrawal stroke and an intervention withdrawal stroke which allows dismantling of these working parts of the tool while on the machine.

BRIEF DESCRIPTION OF THE DRAWINGS

In order that the invention become more apparent, an embodiment will herein-after be described by way of non-limitative illustration, with reference to the appended drawings in which:

FIG. 1*a* represents a partial and schematic vertical section of a tool according to the invention at the end of the working stroke corresponding to the downward stroke of a slide of a stamping tool;

FIG. 1*b* represents a partial and schematic vertical section of a tool according to the invention with its blank-holder performing a normal withdrawal stroke corresponding to the end of the upward stroke of a slide in a stamping tool;

FIG. 1*c* represents a partial and schematic vertical section of a tool according to the invention with its blank-holder forming an intervention withdrawal stroke corresponding to the end of the upward stroke of a slide of a stamping tool;

Figure 2:
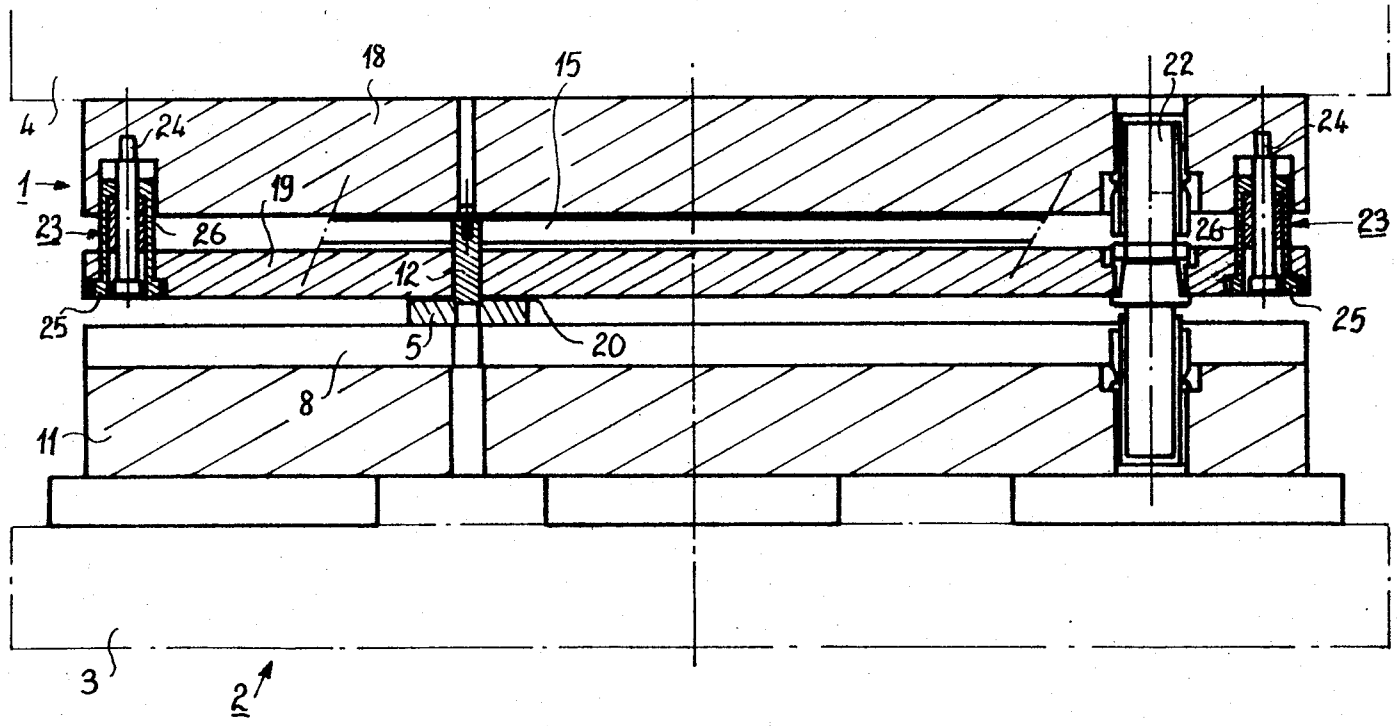
FIG. 2 represents a partial and schematic vertical section of a tool similar to that of FIG. 1, fitted upon a stamping tool, showing the relative positions of their stamps, matrix and blank-holder at the end of the work stroke of the tool.
Figure 3:
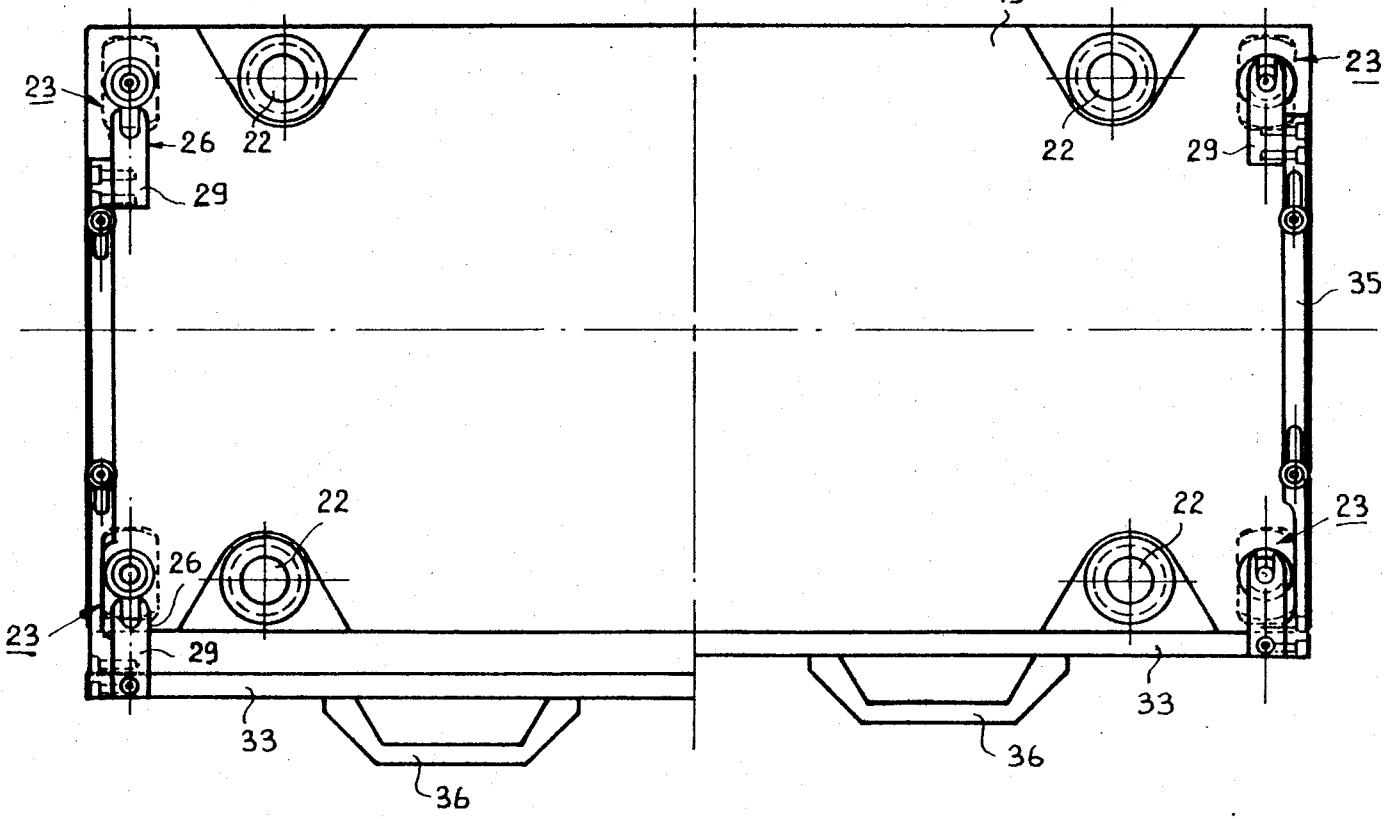
FIG. 3 represents a partial and schematic view from above of the blank-holder of the tool represented in FIG. 2 showing on the right-hand half the blank-holder in normal working position or withdrawal position, and on the left-hand half the blank-holder in intervention position.
Figure 4:
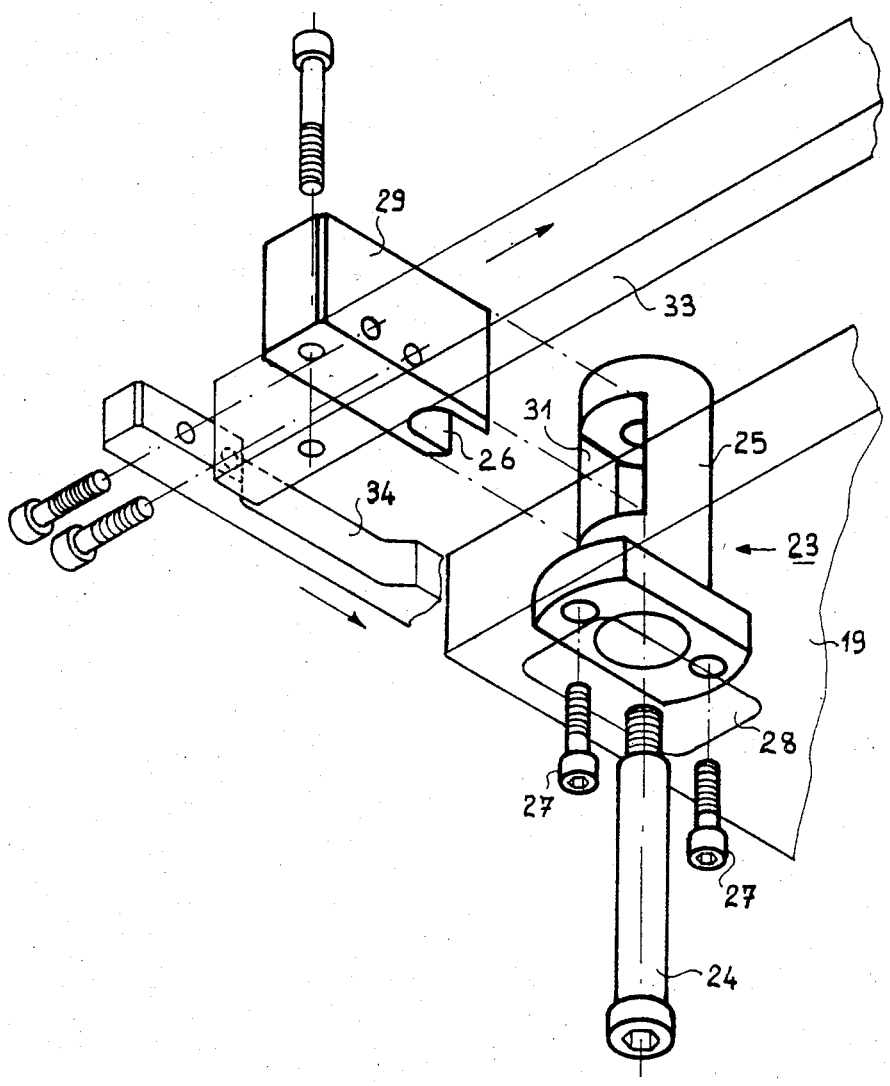
FIG. 4 represents a partial schematic view in perspective of a sliding connection device linking a blank-holder to a bed-plate of the tool, and its control device.

The present invention can be equally well applied to a reworking tool as to a follow-up tool. The term "reworking tool" usually denotes a stamping tool that operates a single time, upon a metal sheet blank in order to confer upon it a more or less complex shape. Operations such as cutting, folding, etc. cannot generally be carried out with a single tool but they are performed upon a range of reworking tools. The term "follow-up tool" usually denotes a tool comprising several aligned work stations, disposed one after another, on which in caused to pass according to a determined interval a strip of sheet metal in order to perform upon this sheet metal strip by each work station a predetermined operation such as stamping, cambering, cutting, etc. . . . and to obtain upon leaving the final work station a finished piece detached from this sheet metal strip and presenting a more or less complex form.

DETAILED DESCRIPTION OF THE PREFERRED EMBODIMENT

A stamping tool 1 produced according to an embodiment of the present invention, illustrated schematically and partially in FIGS. 1 to 4, is a tool of the follow-up type, intended to be fitted or mounted upon a stamping machine 2, the table 3 and the slide-block 4 of which are schematically represented in dashed lines.

Stamping tool 1 comprises at least in the first instance a matrix 5 secured in position by a matrix-holder 8 and a lower attachment block 11 that is mounted upon the table 3 of the stamping machine 2, in the second instance a stamp 12 secured in position within a stamp-holder collar 15 and an upper attachment block 18 that is mounted upon the slide 4 of the stamping machine 2, and in the third instance a blank-holder 19 disposed between this matrix 5 and this stamp and intended both to secure in position a metal strip 20 against this matrix 5 and to guide in its displacement this stamp 12. The matrix 5 and the matrix-holder 8 fixed upon their single block 11 are removable and detachable with respect to this latter. The same is true of the stamp 12 and the stamp-holder 15 with respect to the upper attachment block 18.

The end of the normal working stroke of the slide 2 that coincides with the end of the normal working stroke of tool 1 is represented in FIG. 1*a*, whereas the end of the normal withdrawal stroke of slide 4 of stamping machine 2 that coincides with the end of the normal withdrawal stroke of tool 1 is illustrated in FIG. 1*b*.

Upon completion of a normal withdrawal stroke of the tool 1, the stamp 12 and the blank-holder 19 move away from the matrix 5 (FIG. 1*b*), but this stamp still remains partially engaged within a corresponding form or guiding hole 21, provided in the blank-holder 19. In such relative positions of this stamp 12 and of this blank-holder 19, it is difficult and even impossible to remove this stamp when the tool 1 remains fixed upon the stamping machine 2, i.e. the dismantling of this stamp 12 while on the machine proves to be difficult or even impossible.

According to one essential feature of the present invention, the stamping tool 1 is provided, between the stamp 12 and the matrix 5 with a blank-holder 19 that performs at least one normal working stroke and withdrawal strokes at will, namely a normal withdrawal stroke and an intervention withdrawal stroke. In its normal working stroke, the blank-holder 19 guides the stamp 12 in its displacement and secures firmly in position at the end of this stroke the metal strip 20 against the matrix 5. At the end of its normal withdrawal stroke, the blank-holder 19 is disengaged from the matrix 5 but the stamp 12 still remains partially engaged within the corresponding guiding hole 21 in this blank-holder 19.

In the case of an intervention withdrawal stroke, the blank-holder 19 is disengaged from the matrix 5 and the stamp 12 leaves its guiding hole 21 at the end of the upward stroke of the slide of the stamping machine and is totally disengaged from this blank-holder, as illustrated by FIG. 1*c*.

The blank-holder 19, the stamp 12 and its stamp-holder 15 and the upper attachment block 18 borne by the slide 4 of the stamping machine 2 are respectively guided in their displacement during the working and withdrawal strokes, with respect to the matrix 5 and its matrix-holder 8 and the lower block 11 attached to the table 3 of the stamping machine 2, by four columns 22 (FIG. 3) one of which is represented in a partial section in FIG. 2. The guiding columns 22 are, in the illustrated example, ball type columns of a known type.

According to another essential feature, the blank-holder 19, in order that it may perform its normal working stroke and its two withdrawal strokes at will, is mechanically connected to the upper attachment block 18 that supports the stamp 12 and its stamp-holder 15 by sliding connection devices 23 that each comprise two stop abutments at will, one indicating the end of its normal withdrawal stroke where the stamp 12 still remains partially engaged in the blank-holder 19, and the other representing the end of its normal intervention withdrawal stroke where the stamp 12 is situated completely outside this blank-holder 19.

There are four sliding connection devices 23 in the illustrated example (FIG. 3) each comprising (FIGS. 1*a*, 1*b*, 1*c*, 2, 4) a sheath 25 attached to the blank-holder 19, a retaining screw with stop head 24 attached to the upper block 18 of the tool, through this sheath 25 and a movable or retractable bracket 26 engaging upon this screw 24 between its head and the bottom of the sheath 25. The sheath 25 and the movable bracket 26 act respectively as abutment for the end of the intervention withdrawal stroke and the abutment for the end of the normal withdrawal stroke. The sheath or abutment 25 is constituted by a piece provided with an inverted elongated U-shape having an inverted bottom bored for the sliding of the retaining screw with stop head 24, with lateral wall provided with a passage opening 31 for the bracket 26, and at its free end provided with a retaining shoulder. These shoulders can be provided with holes for attachment screws 27. The sheath or abutment 25 presents a length greater than the thickness of the blank-holder 19 so that during the attachment of this sheath 25 by screws 27 on this blank-holder 19 through a corresponding hole 28 formed in this latter, the bottom of this abutment forms a projection upon the face of the blank-holder opposite the attachment face, of a length equal to the thickness of the retractable bracket or abutment 26 increased by the thickness of the bottom of this sheath or abutment 25. The retractable bracket of abutment 26 is constitited by a piece having two arms extendable by a handle 29 that can be provided laterally with two wings (not represented). These wings 30 confer upon the fork or abutment 26 good stability in displacement during its retraction or return to position. In its return to position (FIGS. 1*a*, 1*b*, 2, 3, right-hand side) the fork or abutment 26 slides upon the surface of the blank-holder 19 and penetrates the sheath or abutment 25 through the passage opening 31 and its handle 29 projects laterally outside the sheath 25. In its retraction (FIGS. 1*c* and 3 left-hand side), the fork or abutment 26 slides on the surface of the blank-holder 19 and leaves the sheath or abutment 25 through passage opening 31.

According to another feature of the invention, the four forks or abutments 26 are attached to the same control device 32 which confers upon them a simultaneous movement in their displacement during their securing in position or their retraction.

This control device 32 comprises a frontal rod 33 and two sliding lateral braces 34, 35 to which are attached the forks or abutments 26. The frontal bar or rod 33 is provided with handles 36 and two braces 34, 35 are slidably mounted along the length of the lateral edges of the blank-holder 19 according to a known technique.

During normal working of the tool 1 in the stamping device 2, in the sliding connection devices 23, the brackets or abutments 26 are simultaneously inserted into the corresponding sheaths or abutments 25 between the bottoms thereof and the stop heads of the sliding retaining screw 24 and in this case the blank-holder 19 has a normal work stroke and a normal withdrawal stroke. At the end of the normal working stroke of the tool 1, the stamp 12, the matrix 5, the blank-holder 19 and the sheet metal strip 20 respectively assume the positions represented in FIGS. 1*a*, 1*b*, and 2 and at the end of the normal withdrawal stroke of the tool 1, in the sliding connection devices 23, the heads of the retaining screws 24 are stopped by the forks or abutments 26, and in the tool 1 the stamp, matrix or blank-holder have respectively the positions partially illustrated in FIG. 1*b*.

During a replacement, service maintenance or change of one or several of the stamps 12 in the sliding connection devices 23, the forks or abutments 26 are simultaneously retracted, i.e. withdrawal from outside the sheaths or abutments 25, by using a control device 36 and in this case, the blank-holder 19 has a normal working stroke identical to that of normal operating of the tool 1 and an intervention withdrawal stroke illustrated in FIG. 1*c* in which the retaining screw heads 24 are stopped respectively by the bottoms of the forks or the abutments 25, and not by the forks or the abutments 26 that have already been retracted or withdrawn. This means that in this intervention withdrawal stroke, the blank-holder 19 moves away from the upper attachment block 18 that bears one or several stamps, by a distance (FIG. 1*c*) that is greater than the distance in the case of a normal withdrawal blank-holder stroke (FIG. 1*b*) so that the stamp(s) 12 is(are) completely disengaged from the blank-holder 19 (FIG. 1*c*). The stamp(s) can thereby be easily dismantled or removed at the same time as the matrix(es) 5 without requiring a dismantling of the tool 1 while not on the machine in order to carry out their change, replacement or service maintenance.

The tool 1 produced according to the invention thereby allows to prevent loss of work time and supplementary man-power costs.

I claim:

1. A tool for stamping a sheet metal piece to form shape on a stamping machine comprising:

at least one matrix element;

at least one stamp element;

a blank-holder means for guiding each said stamp element during displacement thereof and for securing a sheet metal piece to be stamped against each said matrix element during a working stroke; and means for mounting said blank-holder means in a working position and first and second withdrawal positions, said blank-holder means being spaced from each said stamp element and each said matrix element in said second position, whereby each said stamp element and each said matrix element can be repaired or replaced while the tool is mounted on the stamping machine.

2. A tool according to claim 1, and further comprising:

a stamp holder member coupled to each said stamp element;

a matrix holder member coupled to each said matrix element;

an upper block member coupled to a slide of a stamping machine and carrying each said stamp holder; and a lower block member coupled to a table of said stamp machine and carrying each said matrix holder member;

and wherein said means for mounting comprises a plurality of sliding connecting means for mounting said blank-holder means to said upper block mmeber; each said sliding connecting means including first and second stop means; said first stop means defining said first withdrawal position of said blank-holder means wherein each said stamp element is at least partially disposed within said blank-holder means and said second stop means defining said second withdrawal position of said blank-holder means wherein each said stamp element is spaced from said blank-holder means.

3. A tool according to claim 2, wherein each said sliding connecting means comprises:

a retaining screw coupled to said upper block member;

a sheath element slidably mounted on said screw and coupled to said blank-holder means, engagement of a head of said retaining screw with said sheath element providing said second stop means; and a fork element operatively coupled to said screw within said sheath element, engagement of said head of said retaining screw with said fork element providing said first stop means.

4. A tool according to claim 3, wherein each said sheath element has an elongated, inverted U-shaped longitudinal cross section and defines an opening in a lateral wall thereof for slidably receiving each said fork element, respectively.

5. A tool according to claim 3, wherein each said fork element includes a handle portion and two arm portions, said arm portions engaging said retaining screw and said handle portion protruding laterally from said sheath element when said fork element is disposed in said opening of a respective sheath element and operatively coupled to a respective retaining screw.

6. A tool according to claim 3, and further comprising a control device coupled to each said fork element for simultaneously moving each said fork element laterally relative to each said sheath element.

7. A tool according to claim 6, wherein said control device comprises a frontal rod member having handles and two sliding lateral braces, each said fork element being coupled to one of said lateral braces.

* * * * *